US006827594B1

(12) United States Patent
Davis et al.

(10) Patent No.: US 6,827,594 B1
(45) Date of Patent: Dec. 7, 2004

(54) CONNECTOR ASSEMBLY

(75) Inventors: James Dewayne Davis, Waterloo, IA (US); Charles William Formwalt, Jr., Janesville, IA (US); James Edward Sabelka, Denver, IA (US)

(73) Assignee: Deere & Company, Moline, IL (US)

( * ) Notice: Subject to any disclaimer, the term of this patent is extended or adjusted under 35 U.S.C. 154(b) by 8 days.

(21) Appl. No.: 10/601,743

(22) Filed: Jun. 23, 2003

(51) Int. Cl.[7] ..... H01R 13/62
(52) U.S. Cl. ..... 439/157
(58) Field of Search ..... 439/157, 372

(56) References Cited

U.S. PATENT DOCUMENTS

| | | | | | |
|---|---|---|---|---|---|
| 5,595,492 | A | * | 1/1997 | Taguchi | 439/157 |
| 5,709,561 | A | * | 1/1998 | Cadoret et al. | 439/157 |
| 6,102,717 | A | * | 8/2000 | Aoki et al. | 439/157 |
| 6,164,992 | A | * | 12/2000 | Okabe | 439/157 |
| 6,241,540 | B1 | * | 6/2001 | Tokuwa | 439/157 |
| 6,547,574 | B2 | * | 4/2003 | Sasaki et al. | 439/157 |
| 6,602,082 | B2 | * | 8/2003 | Nishide et al. | 439/157 |
| 6,623,287 | B2 | * | 9/2003 | Hatagishi et al. | 439/157 |
| 6,644,991 | B2 | * | 11/2003 | Martin | 439/157 |
| 6,652,306 | B2 | * | 11/2003 | Karamatsu et al. | 439/310 |
| 6,679,711 | B2 | * | 1/2004 | Takahashi | 439/157 |
| 6,702,597 | B2 | * | 3/2004 | Pade | 439/157 |
| 6,733,312 | B2 | * | 5/2004 | Fujii | 439/157 |

OTHER PUBLICATIONS

ISOSTD 1SO Template Verdsion 3.0; 51 Pages; Feb. 07, 1997.

Deutsch Industrial; "Connector"; 2 pages.

* cited by examiner

*Primary Examiner*—Gary Paumen

(57) ABSTRACT

A connector assembly includes a housing and a first connector mounted on the housing and adapted for mating with a second connector. Both connectors have electrical conductors for communicating electrically with each other. The assembly also includes a yoke pivotally coupled to the housing. The yoke is pivotal to an open position and to a closed position. The yoke is engagable with the second connector to move the second connector into full mating engagement with the first connector as the yoke is pivoted to its closed position. A latching device is coupled to the yoke, and the latching device is releasably engageable with the housing to releasably hold the yoke in its closed position. The latching device is operable to unlatch and permit the yoke to be pivoted to its open position and allow the second connector to be disconnected from the first connector if sufficient tension is applied to the second connector in a direction to pull the second connector away from the first connector. The yoke comprises a base member and a pair of spaced-apart limbs projecting from the base member. The limbs are engagable with a shoulder formed on the second connector. The yoke also has a handle which extends from an end of one of the limbs.

18 Claims, 8 Drawing Sheets

10
26
66
16
30
24
28
9
72
70
90
92
44
74
12
48
50
17
11a
9
13a
13
11b
42
84
11c
9
14

CONNECTOR ASSEMBLY

BACKGROUND

The present invention relates to an electrical connector, such as for connecting a tractor electrical system to an implement electrical system.

Standards have been adopted for electronically interconnecting tractors and implements. Such connectors must accommodate high current for actuators and lights, noise free power for electronic modules and communication signal levels for Controller Area Network (CAN) systems. One such commercially available connector is expensive, difficult to mate and un-mate, and subject to chemical contamination and corrosion. This connector is a variation of a standard aluminum shelled connector where the bayonet locking ring replaced with a stainless steel ring with special slits cut into the ring to provide the break-away feature. This connector assembly has one connector and a spring-loaded pivoting cover mounted to a housing. However, with this connector it is difficult to hold up the cover while manipulating the other connector part into mating engagement with the first connector. The second connector has a set of keys which must be aligned with notches on the first connector. Then, the second connector also has an outer ring which has slots which must be aligned with pins which project from the first connector. Then, the outer ring must be rotated to seat the connectors together and compress an O-ring therebetween. The connector components are made of aluminum which has a tendency to bind and make assembly and disassembly difficult.

SUMMARY

Accordingly, an object of this invention is to provide a tractor/implement connector assembly which can be operated easily and safely, which provides high mechanical advantage, and which provides obvious visual feedback when mating is completed.

A further object of the invention is to provide such a tractor/implement connector which is inexpensive.

A further object of the invention is to provide such a connector which is compatibility with existing implement connectors that have been in the field since 1996 and complies with the requirements of ISO 11783, Part 2 International Standard.

Another object of the invention is to provide such a connector which accommodates high current for actuators and lights, clean power for electronic modules, as well communication signal levels for CAN (Controller Area Network).

A further object of the invention is to provide such a connector which is well sealed to operate reliably in the hostile agricultural environment and which is able to withstand accidental separation (break-away).

These and other objects are achieved by the present invention, wherein a connector assembly includes a housing and a first connector mounted on the housing and adapted for mating with a second connector. Both connectors have electrical conductors for communicating electrically with each other. The assembly also includes a yoke pivotally coupled to the housing. The yoke is pivotal to an open position and to a closed position. The yoke is engagable with the second connector to move the second connector into full mating engagement with the first connector as the yoke is pivoted to its closed position. A latching device is coupled to the yoke, and the latching device is releasably engageable with the housing to releasably hold the yoke in its closed position. The latching device is operable to unlatch and permit the yoke to be pivoted to its open position and allow the second connector to be disconnected from the first connector if sufficient tension is applied to the second connector in a direction to pull the second connector away from the first connector. The yoke comprises a base member and a pair of spaced-apart limbs projecting from the base member. The limbs are engagable with a shoulder formed on the second connector. The yoke also has a handle which extends from an end of one of the limbs.

DETAILED DESCRIPTION

Figure 1:
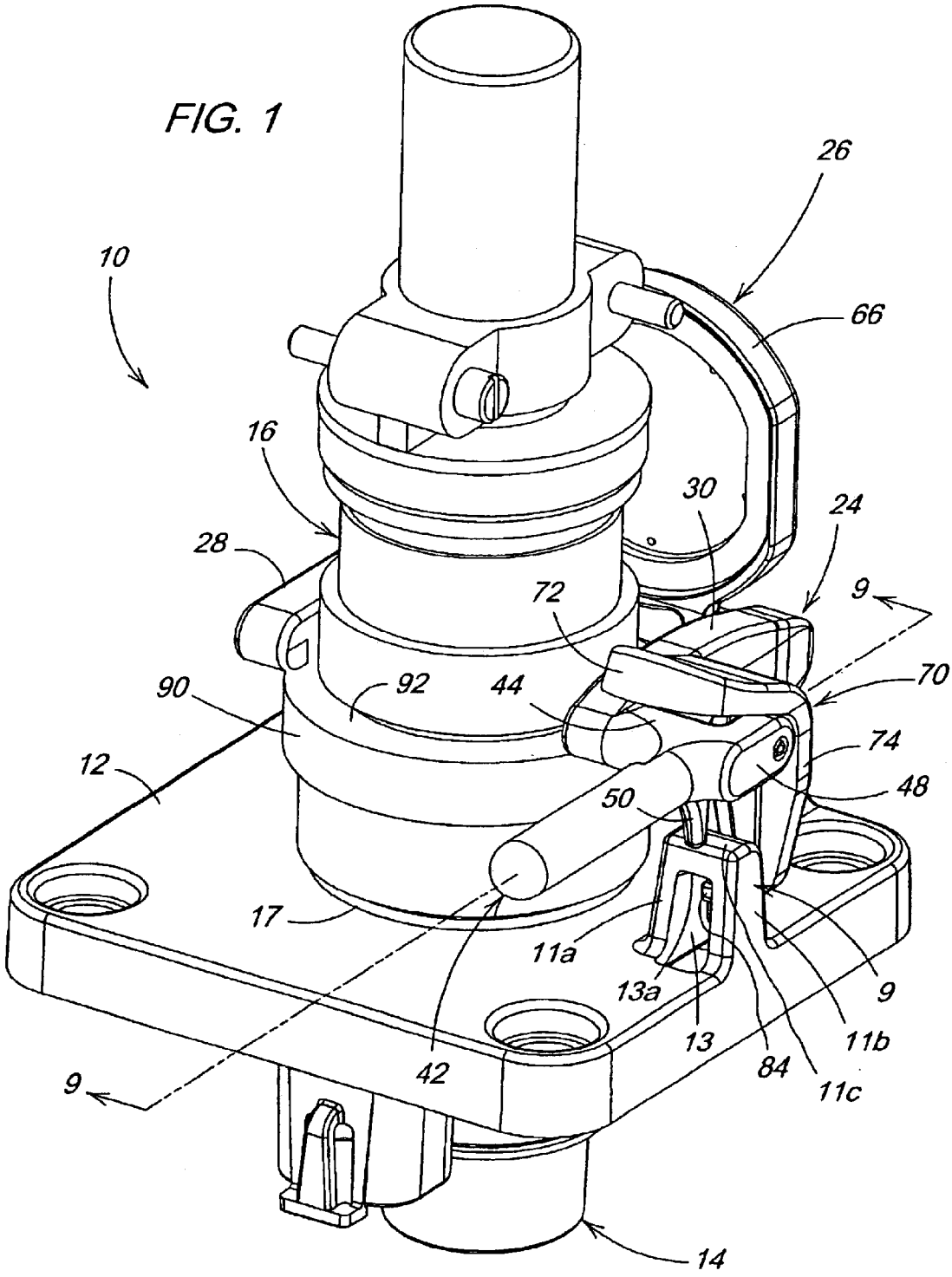
FIG. 1 is a perspective view of a break-away connector assembly from above according to the present invention.
Figure 2:
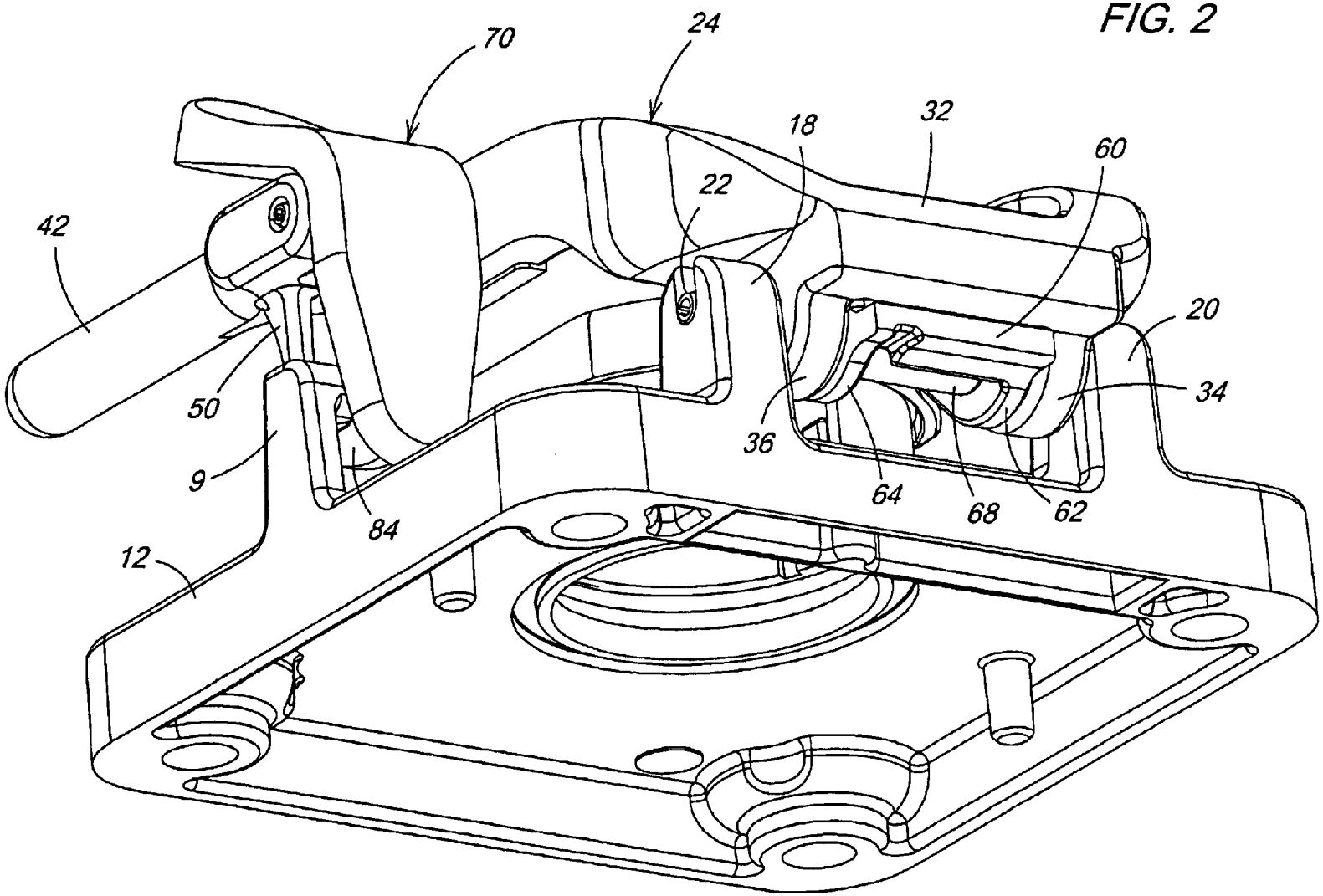
FIG. 2 is a perspective view of the break-away connector assembly from below.

Referring to FIG. 1, a connector assembly 10 includes a platform or housing 12 for mounting on a vehicle, such as an agricultural tractor (not shown). Housing 12 forms a hollow cylindrical sleeve 17 for receiving a first electrical connector part 14. Connector 14 has electrical conductors 15 (FIG. 7) for electrically interconnecting with corresponding conductors (not shown) of a second mating connector part 16. Referring now to FIG. 2, a pair of legs 18, 20 project from one side of the housing 12 and support a pivot shaft 22. Referring again to FIG. 1, an archway 9 projects up from another side of the housing 12. The archway 9 includes a pair of legs 11*a*, 11*b* and a top 11*c*. The archway 9 defines an inner surface 13 surrounding an opening 19. The upper portion of surface 13 forms a latch surface 13*a*.

Figure 3:
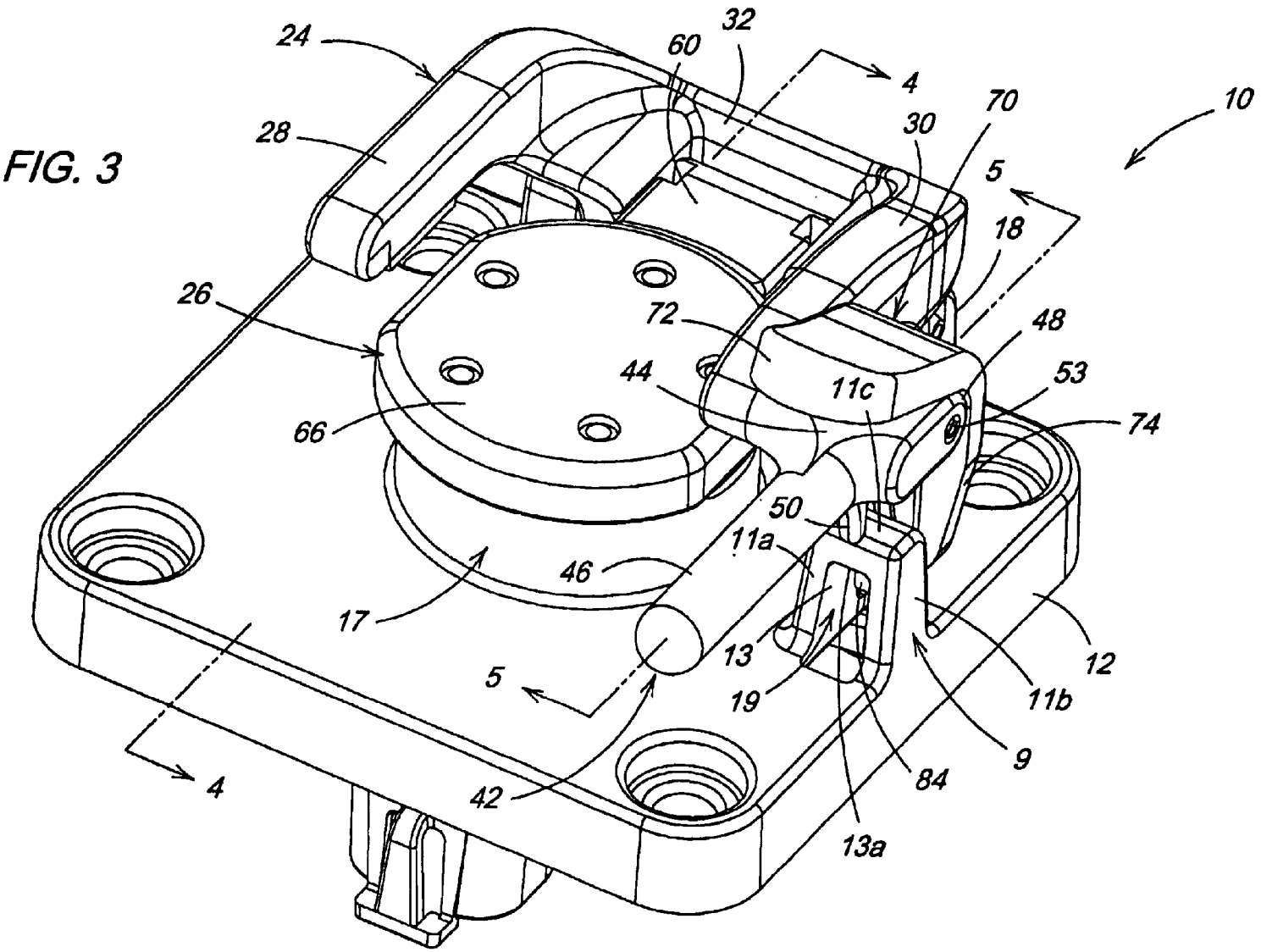
FIG. 3 is a perspective view of the break-away connector assembly similar to FIG. 1, but with the second connector removed.
Figure 4:
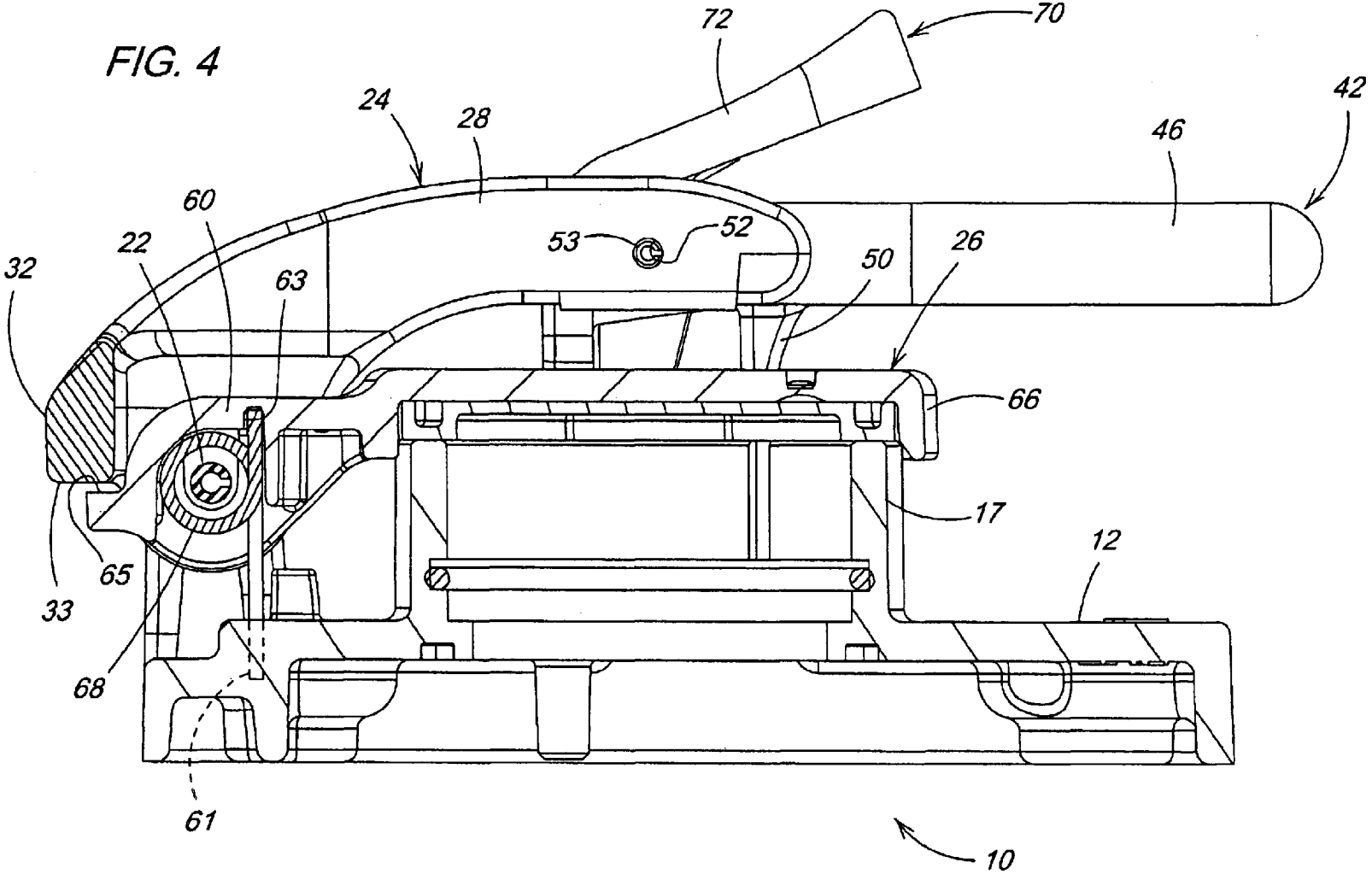
FIG. 4 is a partial sectional view of the connector assembly along lines 4—4 of FIG. 3.
Figure 5:
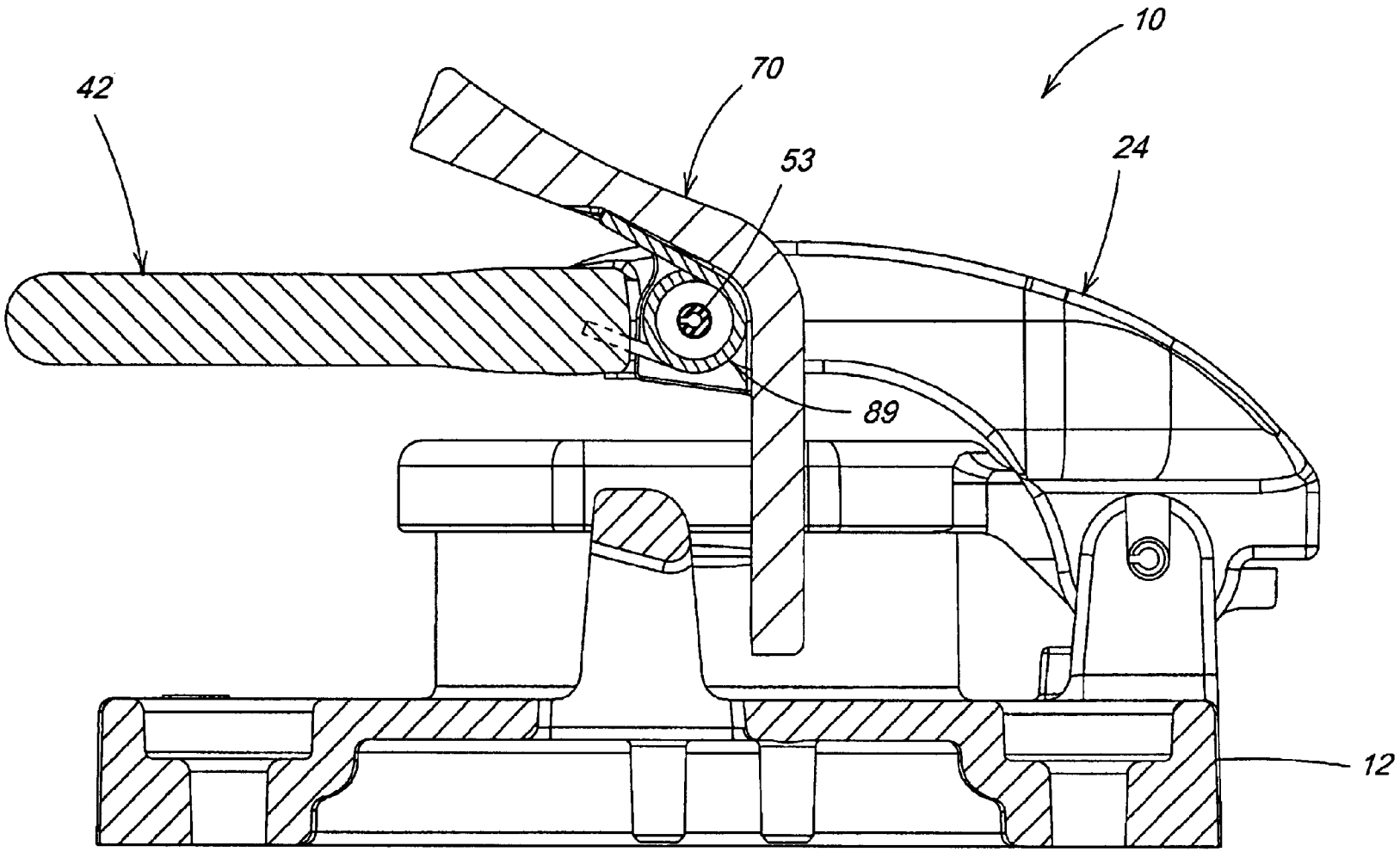
FIG. 5 is a partial sectional view of the connector assembly along lines 5—5 of FIG. 3.
Figure 6:
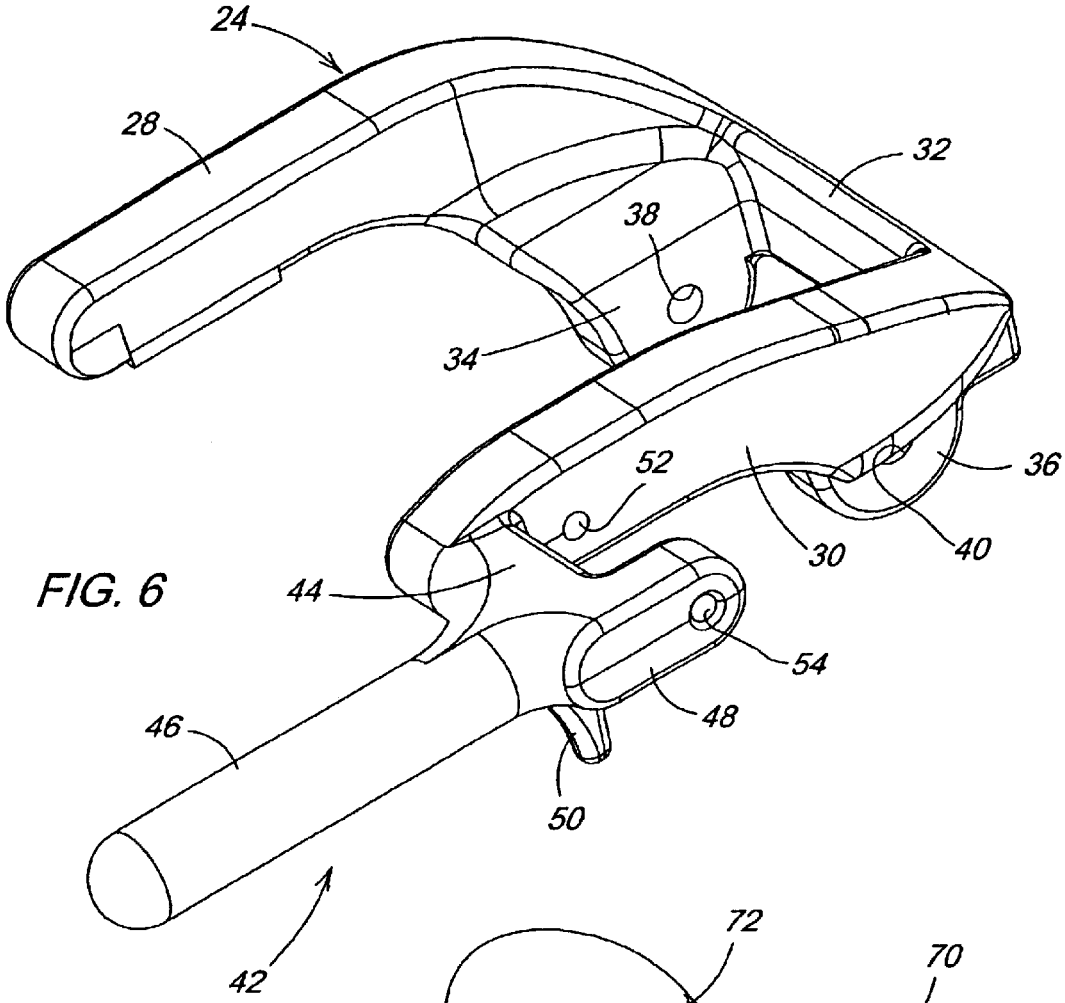
FIG. 6 is a perspective view of the yoke and handle component of the connector assembly.

Referring to FIGS. 3, 4 and 5, a yoke 24 and a cover or lid 26 are pivotally mounted on the shaft 22. As best seen in FIG. 6, the yoke 24 has a pair of spaced-apart limbs 28, 30 projecting from a base member 32. A pair of ears 34, 36 project from an inner portion of each corresponding limb 28, 30. Aligned pivot pin bores 38, 40 extend through ears 34 and 36 for receiving shaft 22. A handle 42 includes a base 44 which is integral with the yoke limb 30 and which projects laterally outwardly from an outer end of limb 30. Handle 42 also includes a shaft 46 which projects away from base 44, a stub 48 which projects from an outer end of base 44 and in a direction opposite to shaft 46, and a leg 50 which projects downwardly from base 44 for engagement with the top 11*c* of archway 9. Aligned pivot pin bores 52 and 54 extend through limb 30 and stub 48, respectively, for receiving pivot pin 53. Stub 48 is spaced apart from the limb 30.

As best seen in FIGS. 2 and 3, the cover or lid 26 has a base 60 with a pair of spaced apart tabs 62, 64 pivotally mounted on shaft 22 between legs 18, 20 and ears 62, 64. Cover 26 also has a cover part 66 which is sealingly engagable with the sleeve 17. The yoke 24 and the cover 26 are pivotal to an open position (FIG. 7) wherein they are both spaced apart from connector 14, and to a closed position (FIGS. 2–5) wherein the yoke straddles connector 14 and wherein the cover 26 engages sleeve 17 and protects connector 14 from the environment.

Figure 7:
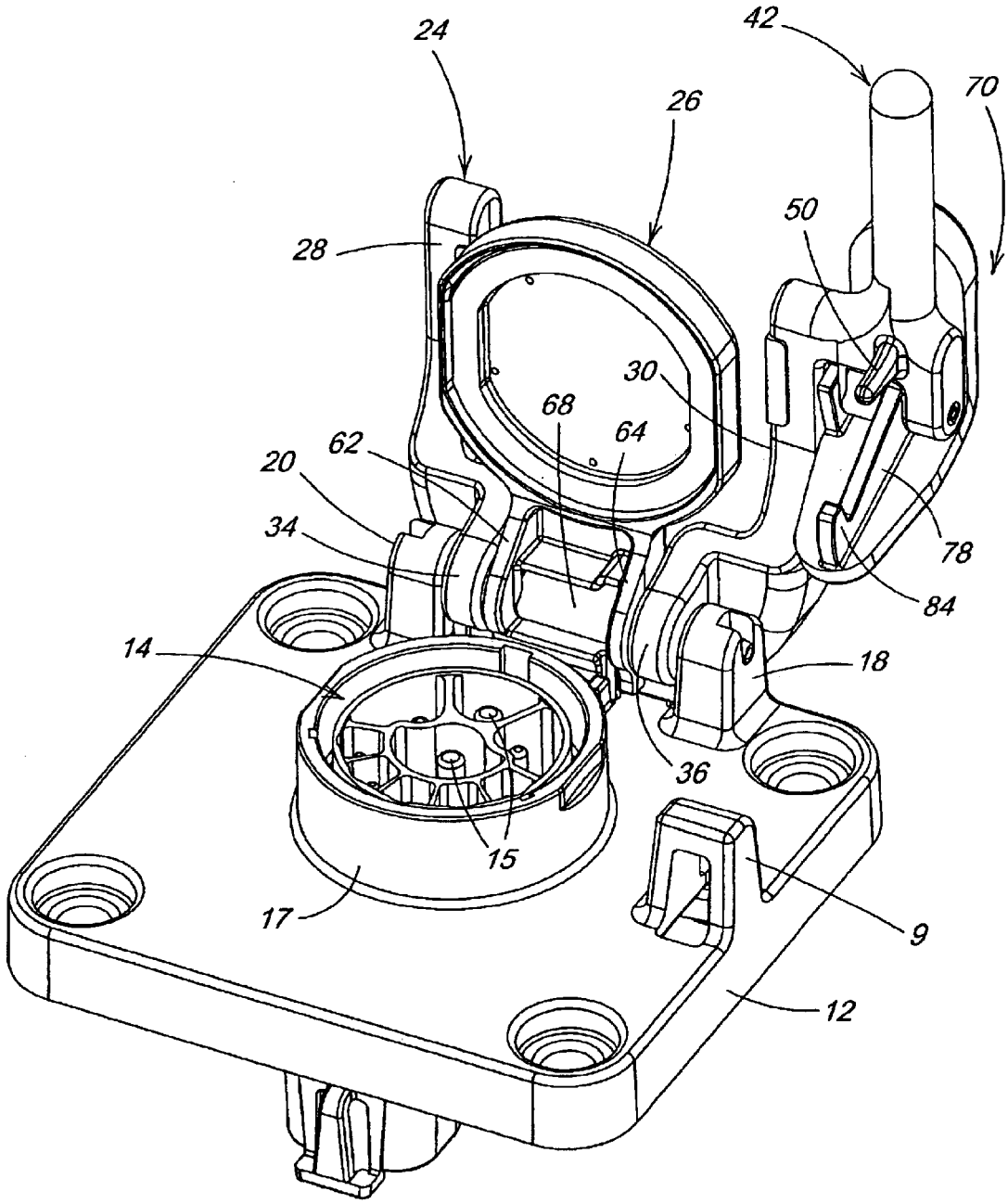
FIG. 7 is a perspective view similar to FIG. 3, but with the yoke; lever, and cover in their open positions.

As best seen in FIGS. 4 and 7, a torsion spring 68 is mounted on shaft 2.2 between tabs 62, 64. One end of spring 6E is received in a bore 61 in the housing 12. The other end of spring 68 is received ii a bore 63 formed on the cover base 60. Spring 68 is biased to urge cover part 62 to its closed position. The base 60 has a shoulder 65 which engages a lower surface 33 of the base member 32 of yoke 24. As a result, spring 68 also tends to pivot the limbs 28, 30 of yoke 24 and handle 42 towards the connector 14. Also, when the Broke handle 42 is lifted away from the housing 12, surface 33 will engage shoulder 65 of cover base 60 and cause cover part 66 to open and pivot away from sleeve 17 and connector 14.

Figure 8:
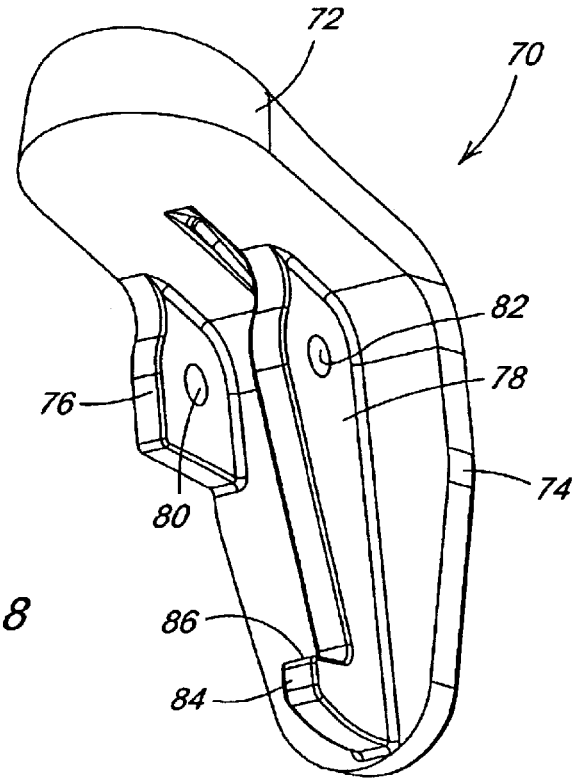
FIG. 8 is a perspective view of the latching lever component of the connector assembly.

Referring now to FIGS. 3, 5, 8 and 9, a latching lever 70 is pivotally mounted on the base 44 of handle 42. Lever 70 has a first arm 72 and a second arm 74 which are joined together at an angle of preferably greater than 90 degrees. As best seen in FIG. 8, a pair of ridges 76, 78 extend away from the intersection of arms 72 and 74. The ridges 76, 78 are received in the space between stub 48 and limb 30. Aligned pivot pin bores 80, 82 extend through ridges 76, 78, respectively. Ridge 78 extends along the center of arm 74 to an end which forms a finger 84. Finger 8 forms a finger surface 86 which is engagable with the latch surface 13*a* of archway 9. The lever pivot pin 53 pivotally couples lever 70 to the handle 42. As best seen in FIG. 5, a lever spring 89 is mounted about pin 53 and is biased to pivot lever 70 clock wise and to move the end of arm 74 towards archway 9. When finger 84 engages latch surface 13*a*, the lever will releasably hold yoke 24 in its closed position shown in FIGS. 3 and 9. The latch lever 70 is preferably formed out of glass re-enforced material to provide a secure connection system and to provide a reliable and accurate break-away function.

Figure 9:
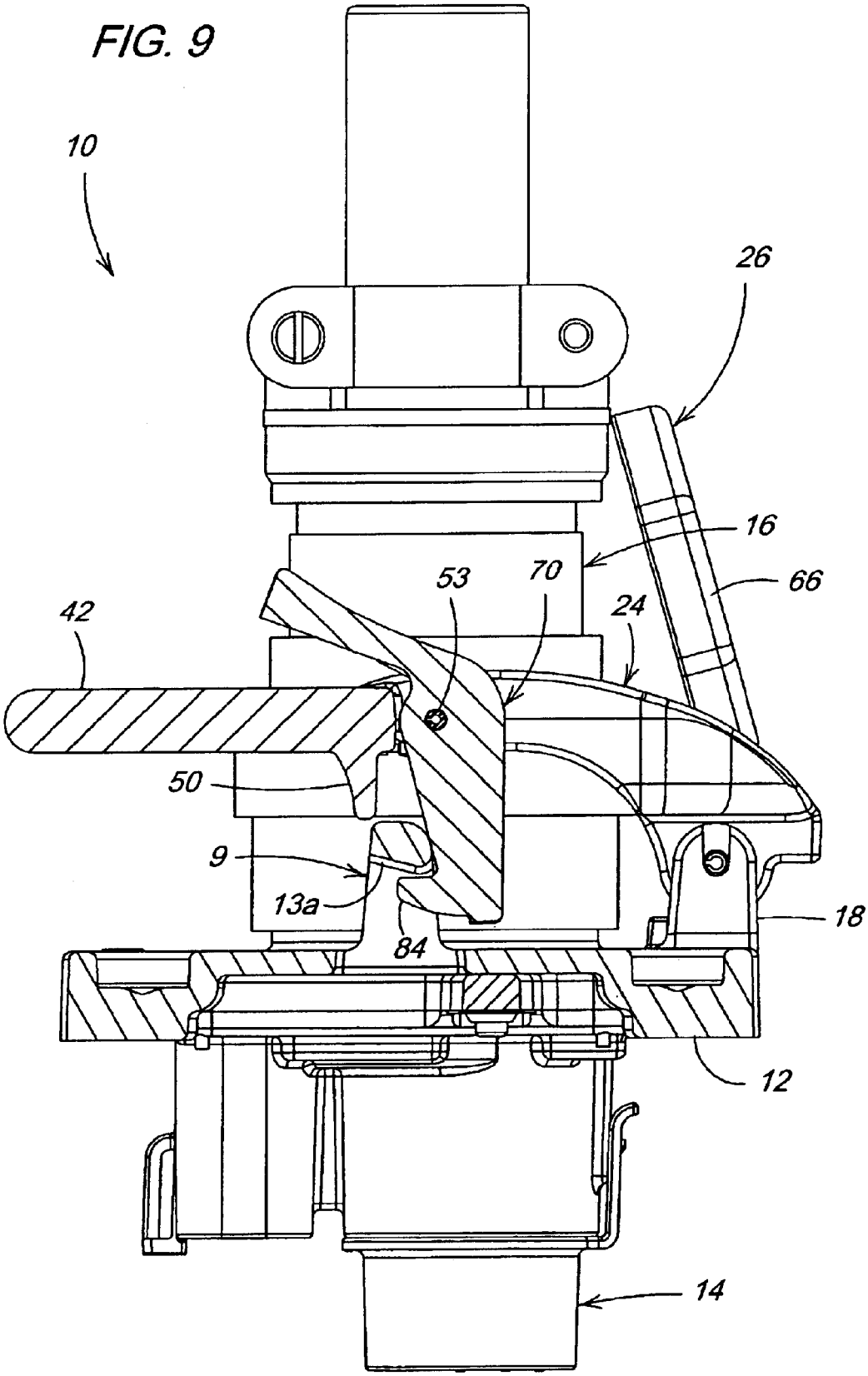
FIG. 9 is a partial sectional view of the connector assembly along lines 9—9 of FIG. 1.

As best seen in FIGS. 1 and 9, second connector 16 has a housing 90 which forms a shoulder 92. To couple or mate connector 16 with connector 14, lever arm 72 is pressed towards limb 30 to pivot level 70 counter-clockwise (viewing FIG. 9) and release finger from archway 9. This allows the yoke handle 42 to be lifted away from the housing 12, and allows cover part 66 to open and pivot away from sleeve 17 and connector 14 to the open position shown in FIG. 7. Then connector 16 is oriented and partially mated with connector 14. The handle 42 and the yoke 24 are then pivoted back towards housing 12 until limbs 28, 30 engage the shoulder 92 of connector housing 90. Further movement of handle 42 and the yoke 24 towards housing 12 to the closed position shown in FIG. 1, will cause the connector 16 to fully seat and mate with connector 14, whereupon, finger 84 will be received by archway 9 and will re-engage with latch surface 13*a*.

As best seen in FIG. 9, the lower surface of finger 84, the upper surface of archway top 11*c* and lever spring 89 are designed so that lever 70 will pivot counterclockwise (viewing FIG. 9) so that finger 84 will slide off of top 11*c* and allow finger 84 to be received by archway 9. In addition, the upper surface of finger 84, the lower surface 13*a* of archway top 11*c* and lever spring 89 are designed so that, if sufficient tension (but less than the tension required to break the electrical conductors attached to connector 14) is applied to the connector housing 90 so as to pull connector away from connector 14, a force is transmitted through limb 30 to lever 70 and thus to finger 84, and this force will cause finger 84 to slide off of surface 13*a* and out of archway 9, thus unlatching yoke 24 from archway 9. This allows yoke 24 to pivot to its open position and allows connector 16 to be uncoupled from connector 14.

Except for the integral yoke 24/lever 70, spring 68, spring 89, and pivot pins 22 and 88, the components of the assembly may be made out composite materials so that they are protected from corrosion. The yoke 24/lever 70 is preferably treated with black powder coat paint to assure chemical resistance. With this design, the yoke 24 and lid 26 may be opened and held by an operator with only one hand, so that the connector 16 can be easily pushed onto connector 14. The operator need not twist or turn the connector with the risk of skinned knuckles or partially engaged connectors. The simple yoke and latching mechanism provides high mechanical advantage and obvious visual feedback when mating is completed.

Because break-away forces are handled by the latching lever 70 which is separate from the connector 16, it will be possible to use a standard plastic shelled plug connector for additional implements, which connector should be less costly than the current aluminum shelled plug. Also, maintenance costs should be reduced because mechanical and electrical/electronic portions of this design may be serviced separately.

The connector 14 and 16 may use three pin sizes in order to meet the specific needs of this standard. An enclosure may be molded into the back of the connector to permit inclusion of the electronic bias and termination circuitry (not shown). The spring loaded cover 26 keeps dirt and moisture out of the connector 14 when not in use. Commercially available 2-pin and 4-pin right angle connectors may be used to provide power to a network and to connect to a vehicle CAN bus. Insert molded electronics may be used to eliminated all bent pins and reduce assembly size.

While the present invention has been described in conjunction with a specific embodiment, it is understood that many alternatives, modifications and variations will be apparent to those skilled in the art in light of the foregoing description. Accordingly, this invention is intended to embrace all such alternatives, modifications and variations which fall within the spirit and scope of the appended claims.

We claim:

1. In a connector assembly having a housing, a first connector mounted on the housing and adapted for mating with a second connector, both connectors having electrical conductors for communicating electrically with each other, the improvement wherein the assembly comprises:

a yoke pivotally coupled to the housing, the yoke being pivotal to an open position and to a closed position, and the yoke being engagable with the second connector to move the second connector into full mating engagement with the first connector as the yoke is pivoted to its closed position; and a latching device coupled to the yoke the latching device being releasably engageable with the housing to releasably hold the yoke in its closed position, and the latching device being operable to unlatch and permit the yoke to be pivoted to its open position and allow the second connector to be disconnected from the first connector if sufficient tension is applied to the second connector in a direction to pull the second connector away from the first connector;

wherein the latching devices comprises:

a latch member on the housing; and a lever pivotally mounted on the yoke, the lever having an arm with a finger projecting therefrom, the finger being releasably engageable with said latch member;

further comprising:

a discrete lever spring coupled between the lever and the yoke and biased to urge the lever to a latched position wherein the finger engages the latch member.

2. The connector assembly of claim 1, wherein:

the yoke comprises a base member and a pair of spaced-apart limbs projecting from the base member, the limbs being engagable with a shoulder formed on the second connector.

3. The connector assembly of claim 1, wherein:

the yoke further comprises a handle extending from an end of one of the limbs.

4. The connector assembly of claim 1, wherein the latch member comprises:

an archway projecting from the housing, the archway defining an inner surface, a portion of said inner surface defining a latch surface which is engageable with the finger.

5. The connector assembly of claim 1, further comprising:

a cover pivotal on the housing to a closed position covering the first connector and pivotal to an open position exposing the first connector, the yoke engaging the cover and pivoting the cover to the cover's open position as the yoke is pivoted to its open position.

6. The connector assembly of claim 1, further comprising:

a cover spring coupled between the cover and the housing and biased to urge the cover to its closed position.

7. In a connector assembly having a housing, a first connector part mounted on the housing, and a second connector part for releasably mating with the first part, both parts having electrical conductors for communicating electrically with each other, the improvement wherein the assembly comprises:

a yoke pivotally coupled to the housing, the yoke having a pair of spaced-apart limbs projecting from a base member, and a handle extending from an end of one of the limbs, the yoke being pivotal from an open position and towards the first connector part to a mated position, the yoke being engagable with the second connector part to move the second connector part into full mating engagement with the first connector part as the yoke is pivoted to its mated position;

an archway projecting from a surface of the housing, the archway having an inner surface surrounding an opening, a portion of said inner surface forming a latch surface;

a latching lever pivotally mounted or a limb of the yoke, the lever having first and second arms projecting away from a hub, the first arm having a finger projecting therefrom, the finger being releasably engageable with said latch surface, the lever being pivotal from a latching position wherein the finger is received by the archway and engages said latch surface, to an unlatched position wherein the finger is removed from the archway and disengaged from said latch surface, the lever holding the yoke in its mated position when the lever is in its latched position, and the lever permitting the yoke to be pivoted away from the first connector part when the lever is in its unlatched position.

8. The connector assembly of claim 7, further comprising:

a yoke spring coupled between the yoke and the housing and biased to urge the yoke to its mated position.

9. The connector assembly of claim 7, further comprising:

a lever spring coupled between the lever and the yoke and biased to urge the lever to its latched position.

10. The connector assembly of claim 7, wherein:

when a decoupling force is applied to the second connector part, the second connector part transmitting at least a portion of said force to the yoke, and the yoke transmitting a portion of said force to the lever and the finger, the finger sliding away from the latching surface if the decoupling force exceeds a predetermined break-away force.

11. In a connector assembly having a housing, a first connector mounted on the housing and adapted for mating with a second connector, both connectors having electrical conductors for communicating electrically with each other, the improvement wherein the assembly comprises:

a cover pivotal on the housing to a closed position covering the first connector and to an open position exposing the first connector; and a yoke pivotally coupled to the housing, the yoke being pivotal to an open position and to a closed position, the yoke engaging the cover and pivoting the cover to the cover's open position as the yoke is pivoted to its open position, and the yoke being engagable with the second connector to move the second connector into full mating engagement with the first connector as the yoke is pivoted to its closed position.

12. The connector assembly of claim 11, wherein:

the yoke comprises a base member and a pair of spaced-apart limbs projecting from the base member.

13. The connector assembly of claim 11, wherein:

the yoke further comprises a handle extending from an end of one of the limbs.

14. The connector assembly of claim 11, further comprising:

a latching device mounted on the yoke, the latching device being releasably engageable with the housing to releasably hold the yoke in its closed position.

15. The connector assembly of claim 14, wherein:

if sufficient tension is applied to the second connector in a direction to pull the second connector away from the first connector, the second connector engages the yoke and unlatches the latching device to permit the yoke to be pivoted to its open position and allow said tension to disconnect the second connector from the first connector.

16. The connector assembly of claim 14, wherein the latching device comprises:

a latch member on the housing; and a lever pivotally mounted on the yoke, the lever having a hub and first and second arms projecting away from the hub, the first arm having a finger projecting therefrom, the finger being releasably engageable with said latch member.

17. The connector assembly of claim 14, wherein the latching device further comprises:

a spring coupled between the lever and the yoke and biased to urge the finger into engagement with the latch member.

18. The connector assembly of claim 17, wherein:

if sufficient tension is applied to the second connector in a direction to pull the second connector away from the first connector, the second connector engages the yoke and disengages the finger from the latch member to permit the yoke to be pivoted to its open position and allow said tension to disconnect the second connector from the first connector.

* * * * *